United States Patent [19]

Simpson

[11] 4,402,543

[45] Sep. 6, 1983

[54] INTERLOCK SYSTEM FOR CONTAINER HANDLER TWIST LOCK

[75] Inventor: Clark C. Simpson, Martin, Mich.

[73] Assignee: Clark Equipment Company, Buchanan, Mich.

[21] Appl. No.: 215,292

[22] Filed: Dec. 11, 1980

[51] Int. Cl.[3] ..... B66C 1/66

[52] U.S. Cl. ..... 294/81 SF

[58] Field of Search ..... 294/81 SF, 81 R, 83 R, 294/86, 111, 112, 113, 67 R, 67 B, 67 BB, 67 BC, 67 D, 67 DB, 67 DA; 414/607, 608

[56] References Cited

U.S. PATENT DOCUMENTS

| | | | |
|---|---|---|---|
| 3,749,438 | 7/1973 | Loomis et al. | 294/81 SF |
| 3,762,754 | 10/1973 | Goyarts | 294/67 R |
| 3,764,032 | 10/1973 | Ward | 214/621 |
| 3,874,719 | 4/1975 | Goyarts | 294/81 SF |
| 3,892,436 | 7/1975 | Fathauer | 294/81 SF |
| 4,017,110 | 4/1977 | Pease et al. | 294/81 SF |
| 4,258,949 | 3/1981 | Keagbine | 294/81 SF |

FOREIGN PATENT DOCUMENTS

| | | | |
|---|---|---|---|
| 682441 | 8/1979 | U.S.S.R. | 294/81 SF |

*Primary Examiner*—James B. Marbert

*Attorney, Agent, or Firm*—John C. Wiessler; Mack L. Thomas

[57] ABSTRACT

A spreader frame assembly for engaging, lifting and transporting freight containers includes a pair of parallel spaced-apart lifting beams. A twist lock is connected at each end of each lifting beam for engagement with a respective corner fitting of a container. Each twist lock includes a shank projecting downwardly from the respective lifting beam. The lower end of the shank is capable of lifting engagement with the corner fitting when the shank is rotated in a selected direction. A circular disc is rigidly connected to the upper end of each shank. A hydraulically actuated mechanism is connected to simultaneously rotate the shanks. A pin having an enlarged upper portion has a first position where the enlarged upper portion of each of the pins is received in a recessed portion in each respective disc to prevent rotation of the respective shank from its no-lift position, and has a second position where the upper portion of the pin is raised above the disc so that the shank may be rotated to a lift position.

8 Claims, 8 Drawing Figures

INTERLOCK SYSTEM FOR CONTAINER HANDLER TWIST LOCK

BACKGROUND OF THE INVENTION

1. Field of the Invention

The field of art to which this invention pertains includes cargo container handling devices and more specifically an interlocking system for the twist locks mounted on the ends of a lifting beam of a container lifting spreader frame.

2. Description of the Prior Art

Large fully enclosed cargo containers in standardized lengths have become a staple of that part of the freight transportation industry which is frequently referred to as "containerization". With the advent of such cargo containers came the need for specialized vehicles adapted to efficiently handle and transport them between major freight transport facilities such as railroads, overland trucks, cargo airplanes and marine freighters.

It will be realized that when shipment involves passage on various types of such transporting means, transfer and transshipment of the cargo containers is necessitated, and various types of prior art machines for lifting and loading such cargo containers to and from one means of transport to another includes cranes and derricks of various forms, straddle lift van carriers, and lift trucks having specialized attachments.

A telescopic spreader frame for cargo container lifting is disclosed as an attachment to a lift truck in U.S. Pat. No. 3,764,032 and as an attachment to a van carrier in U.S. Pat. No. 3,874,719. One type of cylinder and piston assembly for actuating a telescopic container handling spreader frame to a plurality of selectable fixed positions is shown in U.S. Pat. No. 4,017,110. All of the above references disclose a spreader frame having twist lock latching mechanism located at each of its four corners for lifting cargo containers by corner fittings in the four upper corner castings of the cargo container.

Cargo container standards for the dimensions of the unit and location and configuration of the corner fitting have been developed by the International Organization of Standardization (ISO). These standards are frequently but not uniformly followed by cargo container manufacturers. For example, the widely used Sea-Land containers utilize corner fittings at different locations and with different corner fitting configurations than are specified by ISO standards. Universal twist lock mechanisms for a spreader frame for engagement with either ISO standard or Sea-Land cargo containers are disclosed in U.S. Pat. Nos. 3,749,438 assigned to Fruehauf Corporation, and 3,762,754 assigned to the Assignee of the present invention. Both of these twist locks as well as the twist lock used on the spreader frame for the Clark CY800 lift truck have some sort of device associated with them to indicate to the operator the fact that the twist lock has been inserted in the corner fitting and the fact that the twist lock has rotated. These systems are commonly called "interlock systems".

The interlock system used with U.S. Pat. No. 3,749,438 employs separate electrical sensors to signal to the operator that the twist lock has been engaged in the corner fitting and that the twist lock has rotated. Additionally, this system employs a mechanical linkage that connects the two twist locks of a lifting beam together so that the twist locks may be rotated with the activation of a single hydraulic cylinder.

The universal twist lock disclosed in U.S. Pat. No. 3,762,754 employs two shanks each having a hook member at its lower end. The hook members are positioned in different relationships for different corner fittings. This twist lock employs a complex hydraulically actuated linkage with electrical controls and interlock system.

The interlock system in the Clark CY800 spreader frame includes a pin spring biased to a position that prevents the rotation of the lower end of each twist lock. The pin is moved out of its interfering position when the twist lock engages the corner fitting of a container. Each shank is rotated by a separate hydraulic cylinder. This system can use a single lift-no lift electrical signal for each twist lock. The electrical signal is energized when the twist lock is rotated since the twist lock can not rotate until it is engaged with the corner fitting of the container. A disadvantage in this system is that a twisting moment is applied from the engaging hydraulic cylinders to the twist locks when the twist lock is in lifting engagement with respective corner fittings. The interlock system used in the CY800 spreader frame could not be used with the twist lock of U.S. Pat. No. 3,749,438 since this twist lock is free to pivot in its support and could pivot around the pin.

SUMMARY OF THE INVENTION

This invention provides a universal twist lock of simple, inexpensive construction with a single lift-no lift electrical signal for each lifting beam. This is accomplished by providing a pin that selectively interferes with the rotation of the shank of each respective twist lock. Each pin has a first position where the enlarged upper portion of the pin is received in a semicircular cutout formed in a disc that is attached to the upper portion of the shank. Each pin also has a second position in which the lower portion of the shank is inserted in the corner fitting of a container and the pin is in contact with the upper surface of the cargo container so that the upper portion of the pin is raised above the disc to permit rotation of the shank.

A main object of this invention is to provide an improved interlocking system for a twist lock assembly which is simple and inexpensive to manufacture and is also reliable and dependable. Further objects, features and advantages of the invention will become more readily understood by persons skilled in the art when the following detailed description is reviewed in conjunction with the drawing.

DETAILED DESCRIPTION OF THE PREFERRED EMBODIMENT

Figure 1:
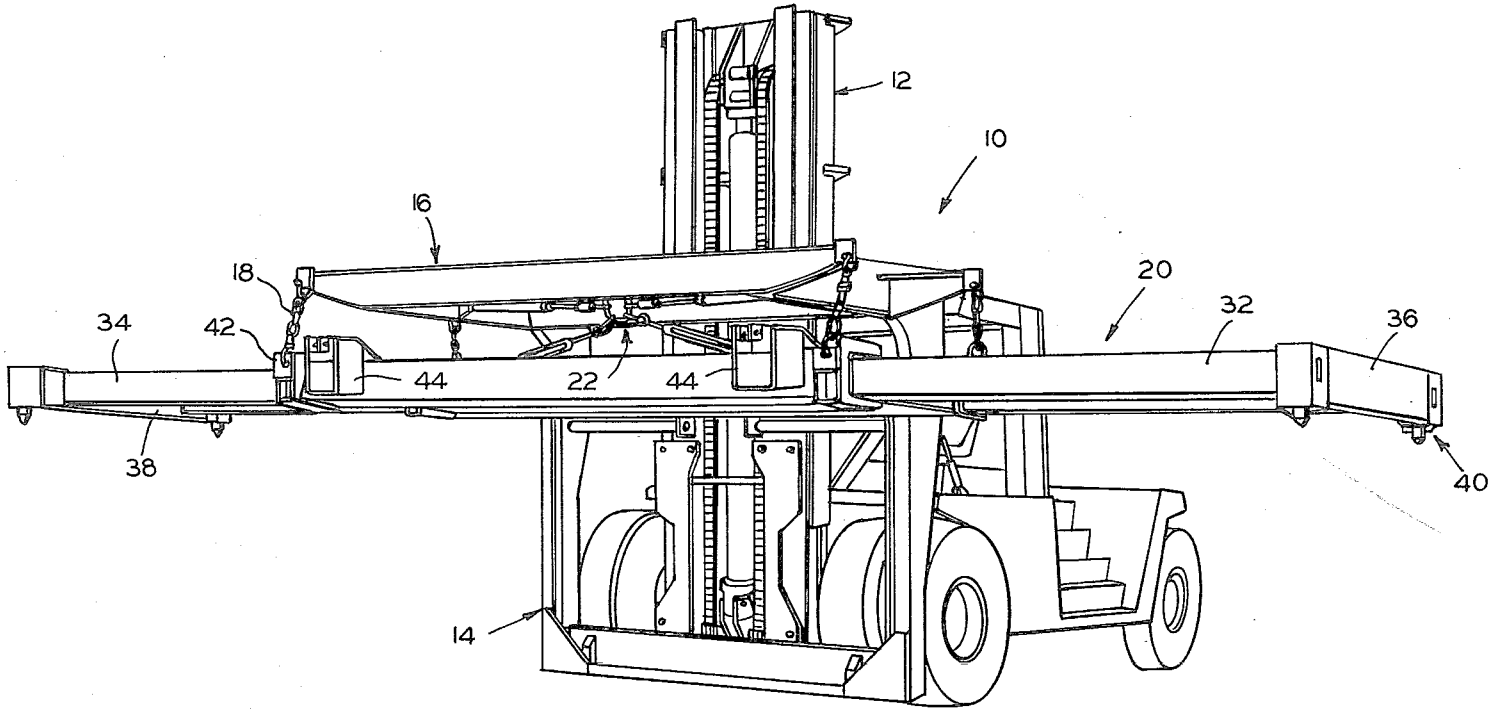
FIG. 1 is a perspective view of the invention as it is applied to an extensible spreader frame for handling various lengths of cargo containers and mounted as an attachment on the upright of a lift truck.

In FIG. 1 is shown generally a lift truck at numeral 10 having a telescopic mast assembly 12 and a carriage assembly 14 mounted thereon for vertical movement from which is mounted an overhead bridge support assembly 16 suspended from the four corner portions of which by means of chains 18 is an extensible spreader frame assembly 20. Hydraulically actuated shifter means, shown in part at 22, is connected between the bridge support and spreader frame assemblies for controlled shifting of the spreader frame on chains 18.

Figure 2:
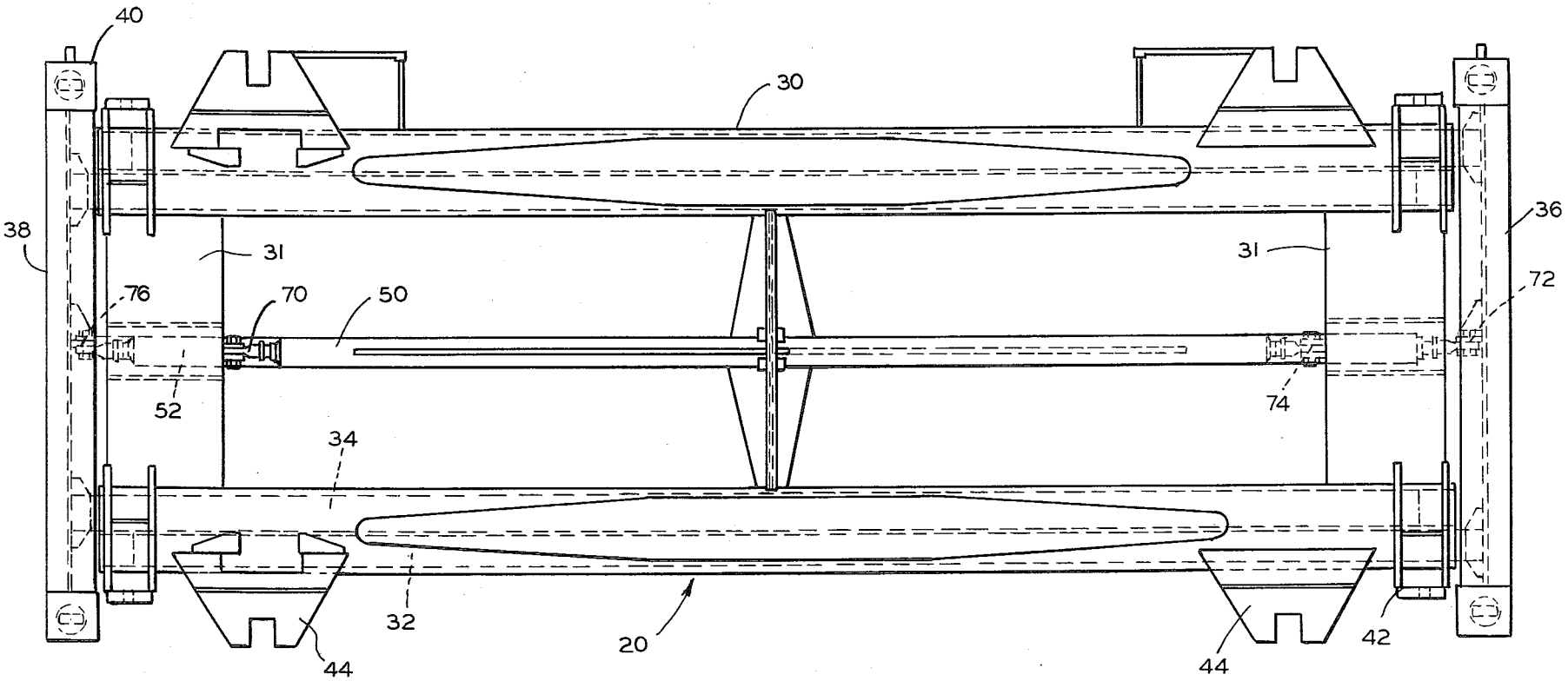
FIG. 2 is a plan view of the spreader frame of FIG. 1.

Spreader frame 20 as shown in FIG. 2 comprises generally a pair of spaced central hollow fixed beams 30 in each of which is mounted a pair of oppositely slidable and extensible hollow beams 32 and 34, beams 32 having secured to the outer ends thereof a transverse beam 36, and beams 34 secured to outer ends thereof at the opposite end of the spreader frame a transverse beam 38. Pairs of beams 32 and 34 are mounted side-by-side for extension in opposite directions. At each end of each of transverse lifting beams 36 and 38 is located a twist lock assembly 40. Adaptor bracket assemblies 42 are located at each end of each fixed center beam 30, the corresponding ends of which are connected to each other by transverse plates 31, for connection to a chain 18, and additional adaptor bracket assemblies 44 are secured adjacent the end of each beam 30 which are adapted for connection with the lifting means of a van carrier machine.

The device for extending and retracting sliding beam assemblies 32 and 34 comprises a pair of cylinder and piston assemblies 50 and 52 located in the same vertical plane. A complete description of cylinder and piston assemblies 50 and 52 can be found in U.S. Pat. No. 4,017,110. Cylinder and piston assembly 50 has its one end pivotally connected to the one transverse beam 31 at 70 and its opposite end pivotally connected to movable beam 36 at 72, while cylinder and piston assembly 52 has its one end connected to the other beam 31 at 74 and its opposite end connected to movable beam 38 at 76.

Figure 3:
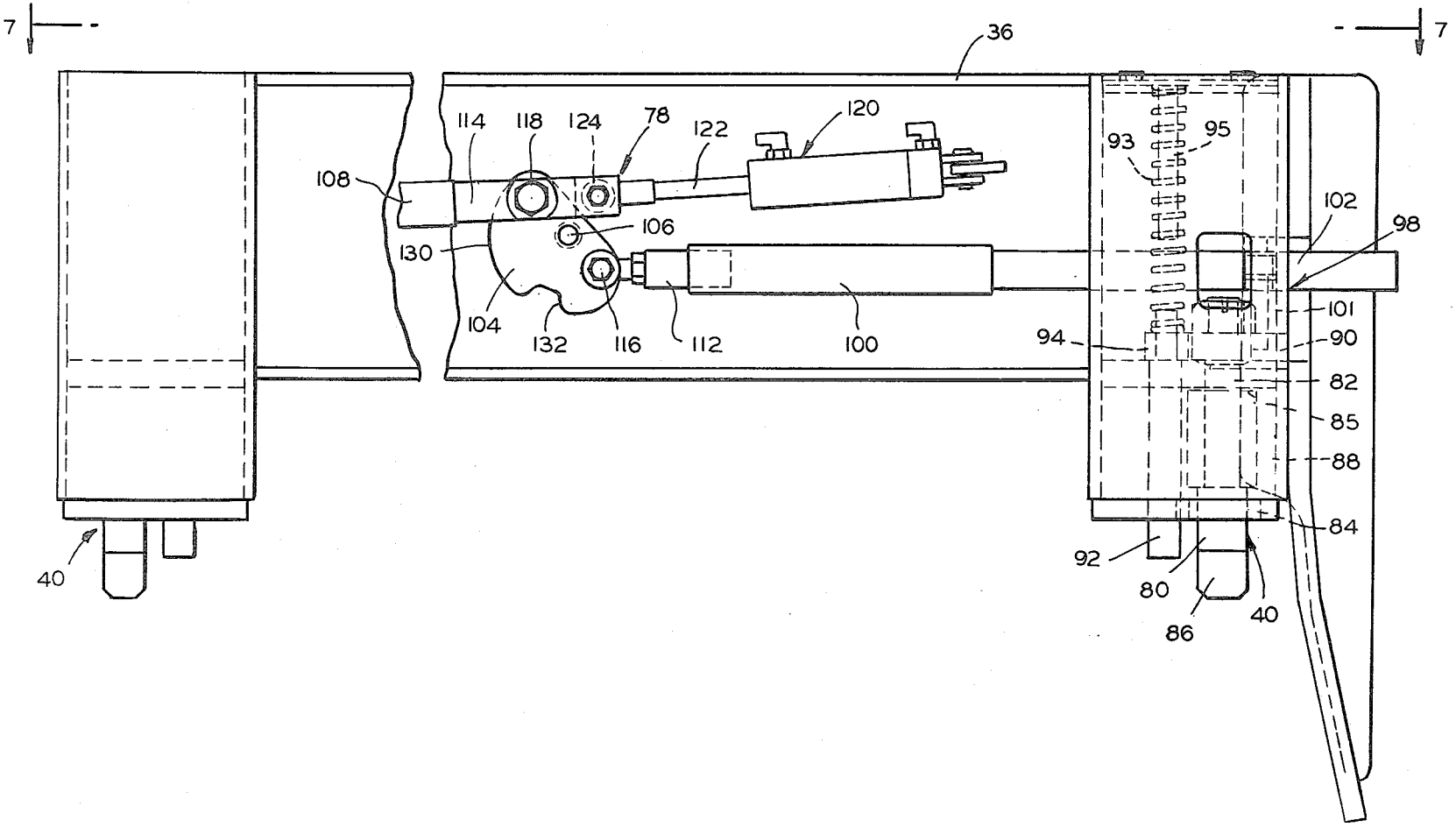
FIG. 3 is a broken away front view in partial section of one of the lifting beams shown in the spreader frame of FIG. 2.
Figure 4:
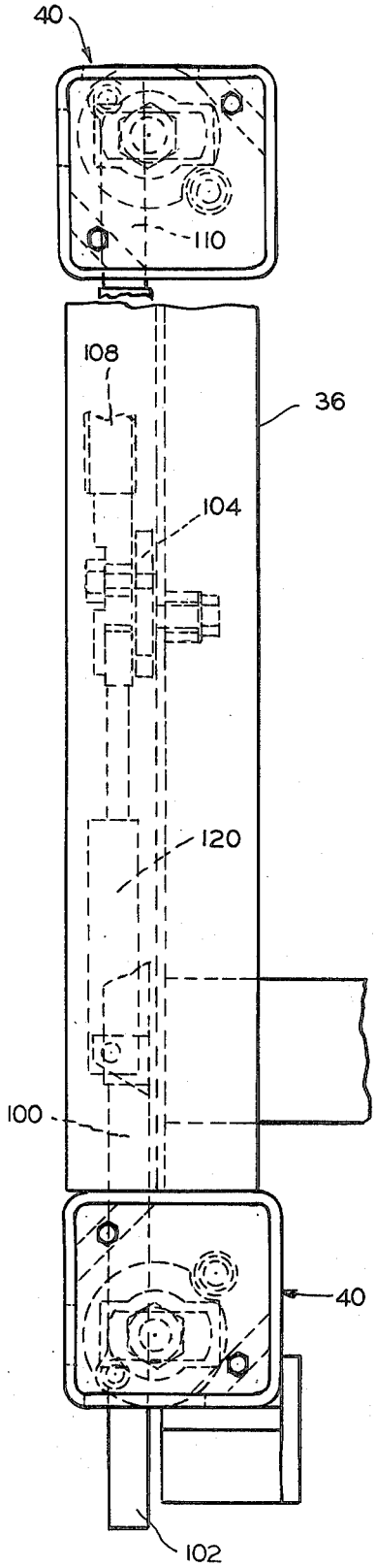
FIG. 4 is a broken away plan view in partial section of the lifting beam in FIG. 3.
Figure 5:
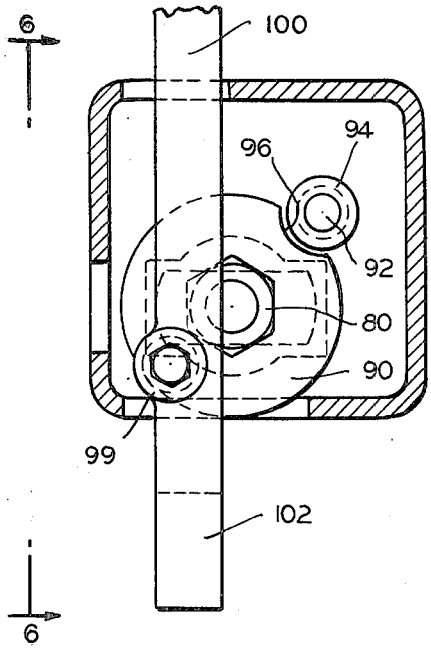
FIG. 5 is an enlarged sectional plan view of the lower end of the lifting beam shown in FIG. 4.
Figure 6:
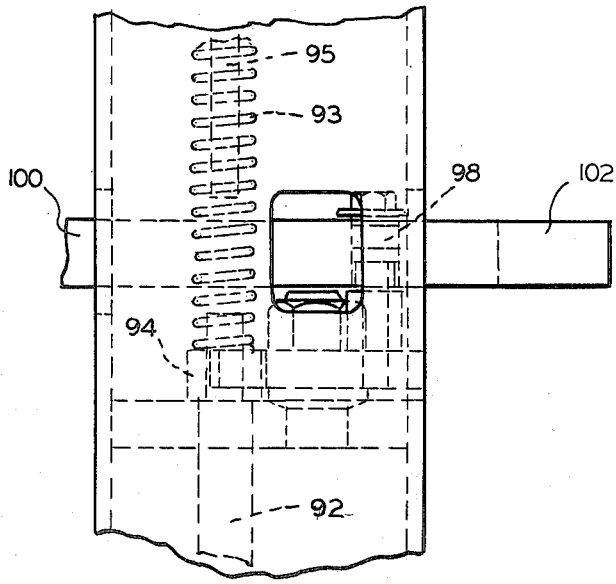
FIG. 6 is a fragmentary sectional view taken along line 6—6 of FIG. 5 showing the pin and twist lock mechanism which embodies the present invention.
Figure 7:
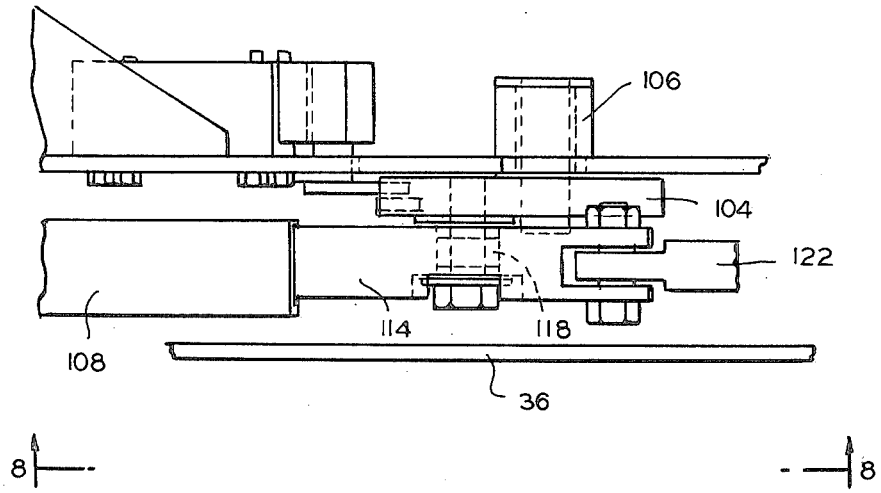
FIG. 7 is an enlarged fragmentary sectional view taken along line 7—7 of FIG. 3 showing the mechanical linkage provided in the lifting beam shown in FIG. 3.
Figure 8:
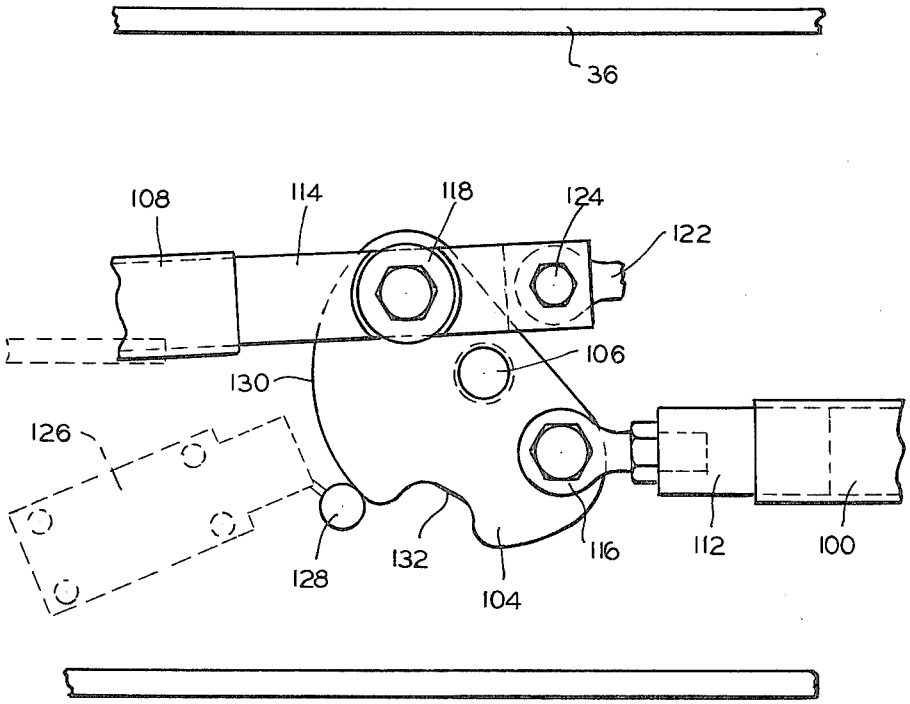
FIG. 8 is an elevational sectional view taken along line 8—8 of FIG. 7 showing the mechanical linkage shown in FIG. 7.

FIG. 3 illustrates a front view of transverse lifting beam 36 with the right sidewall portion of beam 36 broken away to reveal details of construction of twist lock assembly 40. Lifting beam 36 is similar in construction to lifting beam 38 and accordingly a detailed description of lifting beam 38 is omitted. A cylindrical shank 80 having at least two different diameter portions 82,84 is included in twist lock assembly 40. The lower larger diameter portion 84 of the shank is integrally connected to a base or locking portion 86 formed at the lower end of the shank. Twist lock locator 88 is mountable over the enlarged diameter portion 84 of the twist lock assembly 40 whereby it is disposed over and adjacent the locking portion 86 when in operative position. A complete description of the twist lock assembly and twist lock locator can be found in U.S. Pat. No. 3,749,438.

The interlock system of the present invention for each twist lock assembly 40 as best shown in FIGS. 3–8 includes an upper disc portion 90 rigidly attached to the upper diameter portion 82 of shank 80. A rod 95 extends downwardly from the lower surface of the top wall portion of transverse lifting beam 36. One end of a coil spring 93 encircles the rod 95 which is attached at its other end to a pin 92 to bias the pin in a downward direction to a first position where the pin prevents rotation of the shank 80. Pin 92 has an enlarged circular cylindrical upper portion 94 which is in abutment with a semicircular cutout 96 in the outer periphery of disc 90.

In its second position, pin 92 is in contact with the top surface of lifting beam 36 as the locking portion 86 is inserted in the corner fitting so that spring 93 is compressed and cylindrical portion 94 is raised above disc 90 to permit the rotation of shank 80.

Also included in the interlock system is a hydraulically actuated linkage mechanism 78 located in transverse beam 36 to simultaneously rotate both twist lock assemblies 40 in order to lock and unlock the locking portions 86 of respective shanks 80. The linkage mechanism 78 includes a swivel member 104 mounted on a projection 106 extending from a sidewall of lifting beam 36. Swivel member 104 is pivotable about a transverse horizontal axis relative to beam 36 when pin 92 is in its second position. The mechanical linkage 78 also includes drag bars 100 and 108 having respective inner ends 112,114 and outer ends 102,110. The inner end 112 is attached to the bottom of swivel member 104 by spherical bearing 116, and inner end 114 is attached to the top of swivel member 104 by spherical bearing 118. The swivel member 104 pivots in a clockwise direction as shown in FIG. 3 to cause the respective outer ends 102 and 110 to move inwardly and conversely the swivel member 104 pivots in a counterclockwise direction to cause the respective outer ends 102 and 110 to move outwardly. The swivel member 104 shown in FIGS. 3 and 8 has been pivoted in a counterclockwise direction so that outer ends 102 and 110 are fully extended.

Each of the outer ends 102,110 of respective drag bars 100,108 of the mechanical linkage 78 is operatively connected to the circular disc 90 of the respective twist lock assembly 40 by a conventional translator mechanism 98 that converts the linear movement of the drag bars into the rotary movement of respective disc portions 90 and shanks 80. See FIGS. 3 and 5. Translator mechanism 98 includes a spherical bearing 99 provided in an opening in the outer ends 102,110 of respective drag bars 100,108. The spherical bearing 99 is attached to a link member 101 in a known fashion which in turn is fastened to disc 90.

The outer peripheral edge of swivel member 104 has a normal surface 130 having an inward cutout portion 132. A limit switch 126 (FIG. 8) is positioned in cutout portion 132 when the swivel member 104 is rotated clockwise to retract inwardly outer ends 102,110. A spring biased roller arm 128 is extended outwardly to be positioned in cutout 132 to close contacts in limit switch 126 to activate an electrical signal device (not shown), which indicates the respective twist lock assemblies of lifting beam 36 are in a lift position. The mechanical linkage 78 is controlled by a hydraulic assembly 120 which is connected at its rod end 122 by a spherical bearing 124 to the outer tip of the outer end of drag bar 110. Accordingly, extension of hydraulic cylinder assembly 120 will cause counterclockwise movement of swivel member 104 as viewed in FIG. 3 and outward movement of outer ends 102,110 and retraction of hydraulic cylinder assembly 120 will cause clockwise movement of swivel member 104 and inward movement of outer ends 102,110. It should be noted that when outer end 102 is fully extended it projects through an opening in the end plate of lifting beam 36. The outer end 102, which is closest to the operator of the lift truck can be painted a bright color, for example, to be readily observable by the operator of the lift truck to indicate the no-lift position of the twist lock assemblies 40.

OPERATION

To transfer a cargo container from one location to another the lift truck 10 is initially positioned over the cargo container so that the spreader frame 20 may be lowered to insert the twist lock assemblies 40 in their no-lift position into respective corner fittings in the corner castings of the cargo container. When the respective lower locking end portions of the twist lock assemblies are fully inserted in the corner fittings the respective pins of said twist lock assemblies are in contact at their lower ends with the top of the cargo container so that the enlarged upper portion 92 of each pin is raised above the associated disc 90.

To place the twist lock assemblies 40 in their lift position the operator of the lift truck actuates the hydraulic cylinder assemblies 120 of each lifting beam to retract the respective rod end 122. In response to the cylinder movement drag bar 108 attached to cylinder end 122 moves inwardly and pivot member 104 attached at its upper end to drag bar 108 rotates in a clockwise direction so that the lower end of member 104 pivots to the left as viewed in FIG. 3. In response to clockwise rotation of pivot member 104, drag bar 100 attached to the lower end of pivot 104 moves inwardly so that the respective outer ends 102 will disappear from the view of the operator and thus signify that the twist lock assemblies have now been rotated to their lift positions. The inward linear movement of drag bars 100,108 is converted by respective translator mechanisms 98 to rotary motion of the shank 86 so that the shank moves from its no-lift position to its lift position.

Roller arm 128 of limit switch 126 is in rolling contact with the peripheral outer edge of swivel member 104. The clockwise movement of swivel member 104 will position the roller arm 128 in cutout 132. In this position the roller arm 128 is outwardly extended thereby energizing limit switch 126 to activate an electrical signal (not shown) to notify the operator that both twist lock assemblies of a respective lift beam are in a lift position.

At this juncture the cargo container may now be lifted by suitable upward movement of the spreader frame assembly 20. To disengage the spreader frame assembly 20 from a cargo container, the above-described process is reversed.

Although only one embodiment of my invention has been described herein, this disclosure is merely for the purpose of illustration and not as a limitation of the scope of the invention. It is therefore to be expressly understood that the invention is not limited to the specific embodiment shown, but may be used in various other ways, and that various modifications may be made to suit the different requirements, and that other changes, substitutions, additions, and omissions may be made in the construction, arrangement, and manner of operation of the parts without necessarily departing from the scope of the invention as defined in the following claims.

What is claimed is:

1. A lifting beam and twist lock mechanism including two twist locks located adjacent the ends of the beam and capable of engagement respectively with two corner fittings of a cargo container, each twist lock comprising:

an elongated shank extending from the lifting beam and having a lower end capable of lifting engagement with the corner fitting upon rotation of the shank in a selected direction, the shank having an enlarged upper end and having a regular outer surface, the regular outer surface having a recessed portion; and a pin connected with the lifting beam having an enlarged upper portion and a lower portion, the upper portion of the pin capable of engagement with the recessed portion to prevent rotation of the shank, the pin having a biased first position wherein the upper portion of the pin is in engagement with the recessed portion and the lower portion of the pin extends from the lifting beam, and a second position wherein the lower portion of the pin is in contact with the cargo container to raise the upper portion of the pin above the recessed portion so that the shank can be rotated to position the lower end of the shank for lifting engagement with the corner fitting; the mechanism further comprising:

a linkage connected with each of the shanks for effecting the simultaneous rotation of the shanks wherein said linkage includes a pair of bars, each bar having an inner end and an outer end, each of the outer ends operatively connected with the shank of a respective twist lock, each of the inner ends operatively connected to a member swivelably connected with the lifting beam so that each of the outer bar ends moves outwardly in response to swivel member movement in a first direction to rotate respective shanks in a respective first rotative direction and each of the outer bar ends move inwardly in response to swivel member movement in a second direction to rotate respective shanks in respective second rotative directions, a power operated extensible and retractable device connected with the swivel member for effecting the movement of the swivel member, so that when each of the shanks is rotated in one of the respective first and second rotative directions the lower end of each shank is positioned for lifting engagement with a respective corner fitting and that when each of the shanks is rotated in the other rotative position the lower end of the respective shank is positioned for insertion into and withdrawal from the respective corner fitting; and wherein one of the lifting beam ends has an end plate having an opening therethrough and one of the outer bar ends projects through said end plate opening when the respective shank is rotated in one of said first and second rotative directions and is retracted into the lifting beam when the shank is rotated in the other of said rotative directions, said one outer bar end thereby providing a direct visual indication that the twist lock is in condition for lifting a load when said outer bar end is retracted into the lifting beam and is not visible and that the twist lock is not in condition for lifting a load when said outer bar end is extended from the lifting beam and is visible.

2. A lifting beam and twist lock mechanism as claimed in claim 1 whereas each of the lifting beam ends has an end plate having an opening therethrough and each of the outer bar ends projects through its respective end plate opening when the respective shank is rotated in one of the first and second rotative directions and is retracted into the lifting beam when the respective shank is rotated in the other of the rotative directions, both outer bar ends thereby providing a direct visual indication that the twist locks are in condition for lifting a load when the outer bar ends are retracted into the lifting beam and are not visible and that the twist locks are not in condition for lifting a load when the outer bar ends are extended from the lifting beam and are visible.

3. A lifting beam and twist lock mechanism as claimed in claim 1 wherein the said enlarged upper end of each shank is a disc and the regular outer surface is circular.

4. A lifting beam and twist lock mechanism as claimed in claim 3 wherein the enlarged upper portion of the pin is cylindrical and the recess portion of the disc has a semi-circular configuration.

5. The lifting beam as claimed in claim 1 wherein the power actuated device is a hydraulic cylinder assembly.

6. The lifting beam as claimed in claim 1 further comprising electrical switch means operably associated with the swivel member for energizing an electrical signal for indicating when the lower end of each shank is in its lift position.

7. The lifting beam as claimed in claim 6 wherein the indication means includes an outwardly extensible roller arm operatively associated with the switch means so that the switch means is energized when the roller arm is extended and wherein the swivel member has an outer peripheral surface presenting a roller arm contact surface that includes an inward cutout portion, the roller arm being outwardly extendible when it is positioned in the cutout portion.

8. A spreader frame assembly including two substantially parallel spaced-apart lifting beams as claimed in claim 1.

* * * * *